US005349768A

United States Patent [19]

Ishihara et al.

[11] Patent Number: 5,349,768

[45] Date of Patent: Sep. 27, 1994

[54] CLAMP AND TOOTHED BELT CONVEYOR FOR CARRYING LINENS

[75] Inventors: Hidetoshi Ishihara; Atsushi Ueda; Kunio Kojima, all of Nagoya, Japan

[73] Assignee: Mitsubishi Jukogyo Kabushiki Kaisha, Tokyo, Japan

[21] Appl. No.: 62,554

[22] Filed: May 18, 1993

[30] Foreign Application Priority Data

| | | | |
|---|---|---|---|
| Jun. 4, 1992 | [JP] | Japan | 4-168309 |
| Nov. 20, 1992 | [JP] | Japan | 4-333813 |
| Nov. 26, 1992 | [JP] | Japan | 4-337856 |

[51] Int. Cl.[5] ..... D06F 67/04

[52] U.S. Cl. ..... 38/143; 198/465.4

[58] Field of Search ..... 38/143; 198/465.4

[56] References Cited

U.S. PATENT DOCUMENTS

| | | | |
|---|---|---|---|
| Re. 31,453 | 12/1983 | Olsen et al. | 38/143 |
| 2,946,427 | 7/1960 | Friedman | 198/366 |
| 3,552,743 | 1/1971 | Baboz | 38/143 X |
| 4,313,269 | 2/1982 | van Rumpt et al. | 38/143 |
| 4,774,505 | 9/1988 | Ueda et al. | 38/143 X |
| 4,979,868 | 12/1990 | Ueda et al. | 38/143 X |
| 5,168,645 | 12/1992 | Robin et al. | 38/143 |

FOREIGN PATENT DOCUMENTS

| | | | |
|---|---|---|---|
| 0266695 | 5/1988 | European Pat. Off. . | |
| 0266820 | 9/1991 | European Pat. Off. . | |
| 2307907 | 2/1982 | France . | |
| 2652095 | 3/1991 | France . | |
| 1149221 | 8/1984 | Japan . | |
| 0409198 | 1/1992 | Japan . | |
| 4053598 | 2/1992 | Japan . | |
| 2219313 | 12/1989 | United Kingdom | 38/143 |
| 2243816 | 11/1991 | United Kingdom . | |

*Primary Examiner*—Clifford D. Crowder
*Assistant Examiner*—Ismael Izaguirre
*Attorney, Agent, or Firm*—Nixon & Vanderhye

[57] ABSTRACT

In a conveyor for carrying linens having processes of gripping any corner and one place on a side including the corner of a rectangular cloth (sheet 1) with clips 45 installed on a movable clamp 35; naturally hanging the cloth by raising with a clamp transfer conveyor; moving the cloth onto the top surface of a table composed of a flat belt conveyor 77 or the like by using the clamp 35; and pulling the cloth onto the table, the conveyor for carrying linens includes a drive section comprising: a clamp body 36; two pairs of wheels 39 supported by shafts fixed to the clamp body 36; a toothed block 37 which has a plurality of tooth-shaped protrusions engaging with a toothed belt 34 for driving the clamp and is installed straddling over the clamp body 36 by a pin 40 inserted into an elongated hole so that it can be moved downward by the height of the tooth-shaped protrusion; and a compression spring 41 which is energized so as to push the toothed block 37 in the engaging direction, and is engaged between the clamp body and the toothed block 37.

6 Claims, 16 Drawing Sheets

CLAMP AND TOOTHED BELT CONVEYOR FOR CARRYING LINENS

FIELD OF THE INVENTION AND RELATED ART STATEMENT

The present invention relates to a conveyor for carrying linens such as washed sheets by gripping two places.

There have so far been various types of conveyors for carrying linens (sheets, towel, bathrobe, etc.) one after another at a laundry shop or the like. A hanging-type conveyor in which a worker secures two adjacent corners of, for example, a sheet in moving chucks for carrying it is publicly known as a spreader feeder for saving manpower to spread a washed and dehydrated sheet and supply it to a roll ironer.

The conventional conveyor will be described with reference to FIGS. 13 through 16. Reference numeral 1 denotes a sheet representing linen. The sheet 1, after being washed and dehydrated, is untangled and spread by a worker, and carried with two adjacent corners being gripped by chucks 2. The chuck 2 has a torsion spring 23 (FIG. 16), and the sheet 1 is held by being put between a housing 21 and a lever 22.

As shown in FIG. 15, the lever 22 is normally pressed counterclockwise against the housing 21 with a pin 24 being a pivot. The housing 21 has bearings 20 at its top so as to move freely in a supply rail 11. Reference numeral 25 denotes a weight for adjusting the balance. A spreader feeder 10 can spread the sheet 1 by moving the two chucks sent through the rail 11 while gripping two corners of the sheet 1 so as to increase the space therebetween. The spread feeder 10 is an automatic sheet spreading and carrying device for carrying the sheet 1 only to a roll ironer 3 by a belt conveyor by opening the chucks 2 with the sheet 1 being spread. After releasing the sheet 1, the chucks 2 are recovered automatically in the device, and discharged to a recovery rail 12 (FIG. 13).

The rail 11 carries the chucks 2 gripping the sheet 1 to the spreader feeder 10. If the rail 11 is inclined in the gravity direction, the chuck 2 moves by its weight. If the rail 11 is inclined in the direction opposite to gravity or installed horizontally, the chuck 2 moves by being pushed by a bracket 15 mounted to a chain 16 circulating in the drive rail 13 (FIG. 14).

The recovery rail 12, which carries an empty chuck which has released the sheet 1, has the same construction as that of the rail 11. The drive rails 13 and 14 incorporate a resin guide 17 therein, in which the chain 16 circulates. The chain 16 is provided with resin bracket 15 at certain intervals to push and move the chuck 2 in the rail 11 and the recovery rail 12. The chain 16 is circulated by using a sprocket 18 or the like, and has a gap between the roller and the pin so as to be bent vertically and horizontally.

The above-described conventional conveyor basically requires three rails for one line as shown in FIG. 14: the rail 11 for supplying chucks 2, the drive rail (transport side) 13, and the drive rail (return side) 14. Since the chain 16 and the bracket 15 for the drive system are exposed to the outside of the rail, there is a possibility that the linen is contaminated or damaged in a layout in which the linen is carried at a steep incline or the linen is brought into contact with the rail. There is also a great possibility that foreign matter enters into the chain portion, causing a trouble.

Further, it is necessary to align, in installation, the rail through which the chain passes, the rail for the drive system, and the position and height of bracket. At the portion where the chuck 2 begins to be driven by the drive rail 13, the chuck sometimes collides with the bracket 15, by which the bracket 15 or the chuck 2 is damaged or caught, thereby the chain 16 for the drive system being stopped.

Especially in a cloth spreading device having an edge setting process of rectangular cloth in which the cloth is moved by the clamp while contacting with the convex front edge of the table having a horizontal top surface which consists of a belt conveyor or the like, and pulled onto the table, it is necessary to attach any corner and one place on a side including the corner of the rectangular cloth to movable clamp and to move the cloth while holding with clips positioned at certain intervals. With the conventional method in which the linen is carried with two chucks having a free interval, it is difficult to pull the cloth transversely on the table so that the width is aligned.

In the linen supply section of the conventional conveyor, the stop position in chucking is fixed. Therefore, a worker who secures linen in the chucks sometimes must assume an unnatural posture depending on the body dimensions of the worker, which increases the fatigue of the worker and decreases the work efficiency. Additionally, in the linen supply section, the conveyor sometimes carries the chuck even if the chuck does not grip the linen surely. Therefore, the worker must check for proper gripping of linen after securing the linen in the chuck, and press a supply verification switch.

Even if missing of gripping or poor gripping of linen is found after the linen is supplied, the linen is sent to the next process as it is with the conventional conveyor; the linen cannot be removed at the halfway position. Therefore, the poorly gripped linen is caught by the conveyor or improperly handled in the subsequent process, thereby the efficiency of machine being decreased.

OBJECT AND SUMMARY OF THE INVENTION

The present invention has been made to solve the above problems.

A first subject matter of the present invention is a conveyor for carrying linens having processes of gripping any corner and one place on a side including said corner of a rectangular cloth with clips installed on a movable clamp; naturally hanging the cloth by raising with a clamp transfer conveyor; moving the cloth onto the top surface of a table composed of a flat belt conveyor or the like by using the clamp; and pulling the cloth onto the table, wherein the conveyor for carrying linens includes a drive section comprising: a clamp body; two pairs of wheels supported by shafts fixed to the clamp body; a toothed block which has a plurality of tooth-shaped protrusions engaging with a toothed belt for driving the clamp and is installed straddling over the clamp body by a pin inserted into an elongated hole so that it can be moved downward by the height of the tooth-shaped protrusion; and a compression spring which is energized so as to push the toothed block in the engaging direction, and is engaged between the clamp body and the toothed block.

A second subject matter of the present invention is a conveyor for carrying linens according to the first subject matter wherein the conveyor for carrying linens has a clip for gripping a cloth comprising: a clip housing; a pin installed to the clip housing; a cloth gripping member which is supported by the pin and rotates in the clip housing; a torsion spring energized in the rotating direction in which the cloth gripping member wound around the pin is pushed against the clip housing; a cloth release bar extending over the clip in such a manner that it can be moved vertically; and a cam lever which engages with the cloth release bar and opens/-closes the cloth gripping member.

A third subject matter of the present invention is a conveyor for carrying linens according to the second subject matter wherein a pair of clips are installed to both ends of a girder mounted horizontally and at right angles to the running direction of the clamp body.

A fourth subject matter of the present invention is a conveyor for carrying linens according to any of the first to third subject matters wherein the conveyor for carrying linens comprises a pair of opposing rails for vertically guiding a clamp body; a set of opposing rails for transversely guiding a clamp body; a toothed belt running in a conveyor rail; a clamp body; two pairs of wheels which are supported by horizontal shafts fixed to the clamp body and guided by the pair of opposing rails; and two pairs of wheels which are supported by vertical shafts fixed to the clamp body and guided by the set of opposing rails.

A fifth subject matter of the present invention is a conveyor for carrying linens having a linen supply section where a clamp is put on a drive conveyor after running on an inclined free conveyor, going down slantwise, any corner and one place on a side including the corner of a rectangular cloth are gripped by clips, and then the clamp rises slantwise to hang the cloth, wherein the conveyor for carrying linens includes a linen supply work height adjusting device comprising: a proximity sensor which is installed at the halfway position of the rail of the drive conveyor running down slantwise and detects the passing of the clamp; a timer with a setting device which is activated by the signal from the proximity sensor and can adjust the set time; and control means which stops the conveyor by means of the output signal generated after the set time of the timer.

A sixth subject matter of the present invention is a conveyor for carrying linens according to the fifth subject matter wherein the conveyor for carrying linens comprises linen grip verifying means in which a light beam is generated in parallel to the running direction of the conveyor between a pair of clips of linen holding clamp, and light sensors for receiving the light beam are installed.

According to the first to third subject matter of the present invention, one side edge of a rectangular cloth can be easily gripped. Also, there is no possibility of contaminating the cloth during transfer since the drive section of the clamp is apart from the gripping section of the cloth, and additionally the use of drive belt eliminates the possibility of contamination due to lubricating oil. When the clamp is put on the drive rail, the clamp can be put on the toothed belt at any time at any place in running at the position where the drive starts. Therefore, if this conveyor is employed in a sheet feeder or other apparatus which spread sheets at a high speed, a waste of time is eliminated, greatly improving the handling capacity. Further, the construction of the drive rail is simple, thereby the cost being reduced.

According to the fourth subject matter of the present invention, the wheels supported by the horizontal shafts installed to the clamp body are vertically guided by a pair of opposing rails, and similarly the wheels supported by the vertical shafts are transversely guided by a set of opposite rails. Therefore, the clamp does not strike against or rub the drive conveyor rail or the free conveyor rail.

According to the fifth subject matter of the present invention, the linen supply work can be performed by stopping the linen clamp at a height suitable to the body dimensions of the worker, so that the workability is improved and poor gripping of linen is reduced. As a result, the fatigue of the worker is decreased and the work efficiency is increased. Further, it can be verified that the linen is surely gripped by the clips, thereby the failure in the supply of linen being prevented. The worker need not push the supply verification switch, and the supply of linen is automatically verified. Therefore, the fatigue of the worker is decreased and the work efficiency is increased.

According to the sixth subject matter of the present invention, the gripping of the linen can be detected reliably by two sensors over the entire range of stop position even if a means for changing the stop position of the clamp is provided. If worker's mistake on the supply of linen (gripping by only one clip, improper gripping position of supplied linen, etc.) or defective linen having a stain, contamination, or tear is found, the worker can remove the improper linen easily and surely, thereby the efficiency of the machine being improved.

DETAILED DESCRIPTION OF PREFERRED EMBODIMENTS

Figure 1:
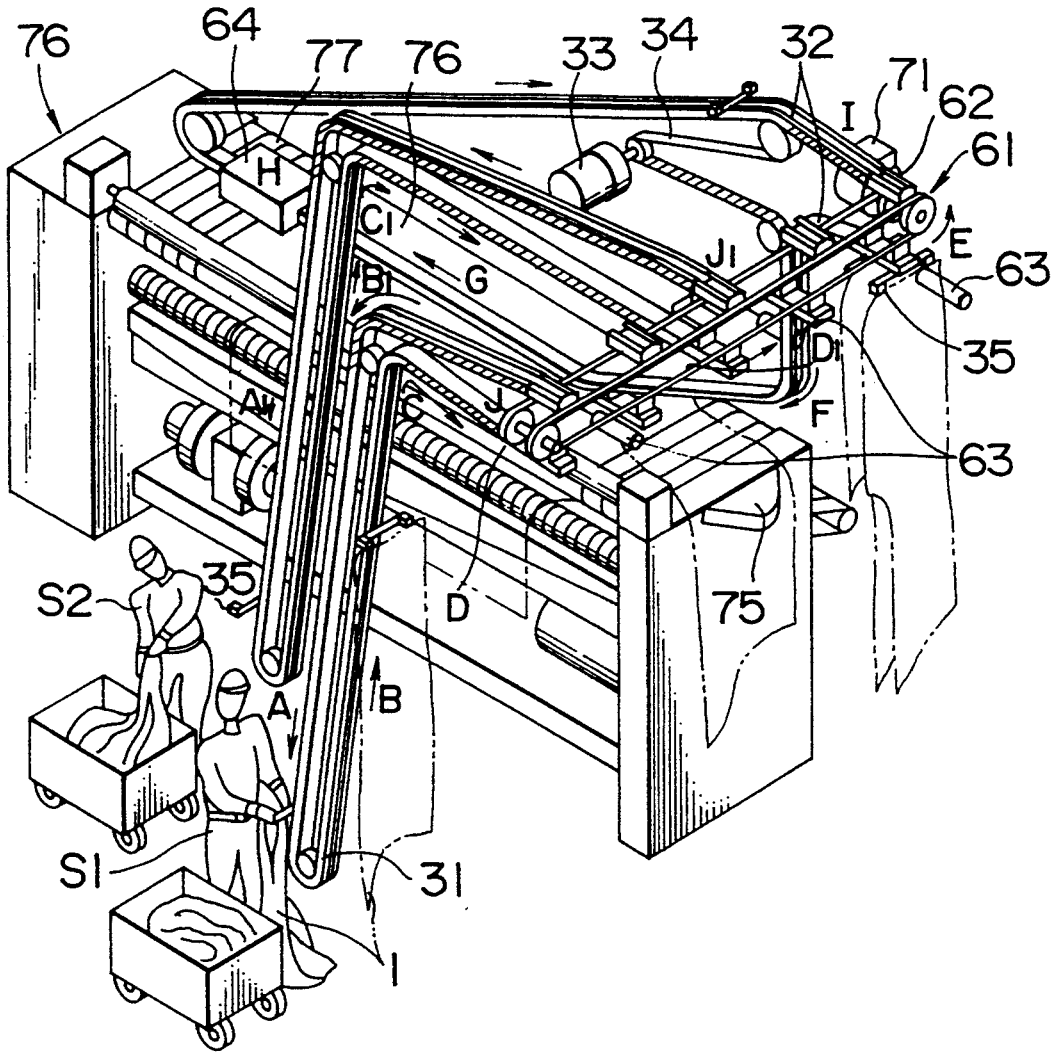
FIG. 1 is a perspective view of a sheet spreading apparatus in accordance with an embodiment of the present invention.

An embodiment of the present invention will be described with reference to the drawings. FIGS. 1 through 7 show an embodiment of the present invention. FIG. 1 is a perspective view of a sheet spreading apparatus for washed sheets. In FIG. 1, a sheet 1 is supplied by hands of a worker S1 to an empty clamp 35 (illustrated in detail in FIG. 6) having two clips 45 which is sent with a drive conveyor rail 31 (a toothed belt driven by a pulley rotated by a not illustrated drive motor is incorporated). Any corner of the sheet 1 is gripped by the clip 45 on the left side viewed toward the worker and one side including the corner is gripped by the clip 45 on the right side (position A in FIG. 1).

The clamp 35 gripping the sheet 1 rises in the direction of arrow B through the drive conveyor rail 31. At the uppermost point, the clamp 35 transfers to a free conveyor rail 32 inclined slightly downward to lower in the direction of arrow C, and temporarily stops at the position of lower end D. A transverse transfer device 61 intermittently transfers clamp cases 62 at certain intervals. When the clamp case 62 stops at position D, it is possible to transfer the clamp 35 from the conveyor rail 32 to the clamp case 62. One or a plurality of clamps 35 are pushed into the clamp case 62 by a sequential feeding device (not shown) for feeding the clamp 35 with an air cylinder.

Then, the transverse transfer device 61 intermittently transfers clamp cases 62. The clamp case 62 containing clamps 35 reaches position E and stops there. Then, an air cylinder 63 operates to push a clamp girder 42 of the clamp 35 which is in the clamp case 62 and grips the sheet 1 to push out the clamp 35. The clamp 35 which has been pushed out is transferred to the drive conveyor rail 31 via a short free conveyor rail 32 to move to an edge setting process.

The drive conveyor rail 31 to which the clamp 35 has transferred has a toothed belt 34 running inside the rail. The toothed belt 34 runs by a pulley which is driven by the drive motor 33. The sheet 1 whose any corner and one side including the corner are gripped by two clips 45 of the clamp 35 is brought into contact with a convex front edge 75, spread in width while being subjected to frictional resistance, and pulled in the direction of arrow G when it lowers slantwise from position F of the drive conveyor rail 31. At the longitudinal dividing position on a table 76 consisting of a flat belt or the like, the sheet 1 leaves the clip 45 by means of a sheet grip releasing device 64. This action enables the setting of one side edge of the sheet 1. The sheet 1 is carried toward the left in the FIG. 1 by the flat belt 77 which moves intermittently. In the next process, the whole of sheet 1 is spread on the basis of the sheet side edge which has been set.

The sheet grip releasing device 64 (FIG. 7) at position H in FIG. 1 releases the sheet 1. The emptied clamp 35 rises slantwise while being driven, and transfers to the free conveyor rail 32 at the uppermost point. After stopping temporarily at position I, the clamp 35 is pushed into the clamp case 62 by a sequential feeding device 71 when the position of the clamp case 62 coincides with the free conveyor rail 32. The clamp case 62 is carried intermittently, reaching position J, where the clamp 35 is transferred to the free belt conveyor rail 32 and then to the drive conveyor rail 31 by the air cylinder 63. The clamp 35 is carried to position A, that is, the position in front of the worker, where the sheet is gripped again. Thus, the same process is repeated. The timing of start and stop of driving devices and actuators is determined and the start and stop thereof are effected by the signal of not illustrated various sensors and not illustrated control units.

The clamping device of the present invention is best suitable for the use in a sheet carrying conveyor device and a sheet edge setting device as describe above. The detailed construction and operation of the clamping device will be described below with reference to FIGS. 2 through 7.

Figure 2:
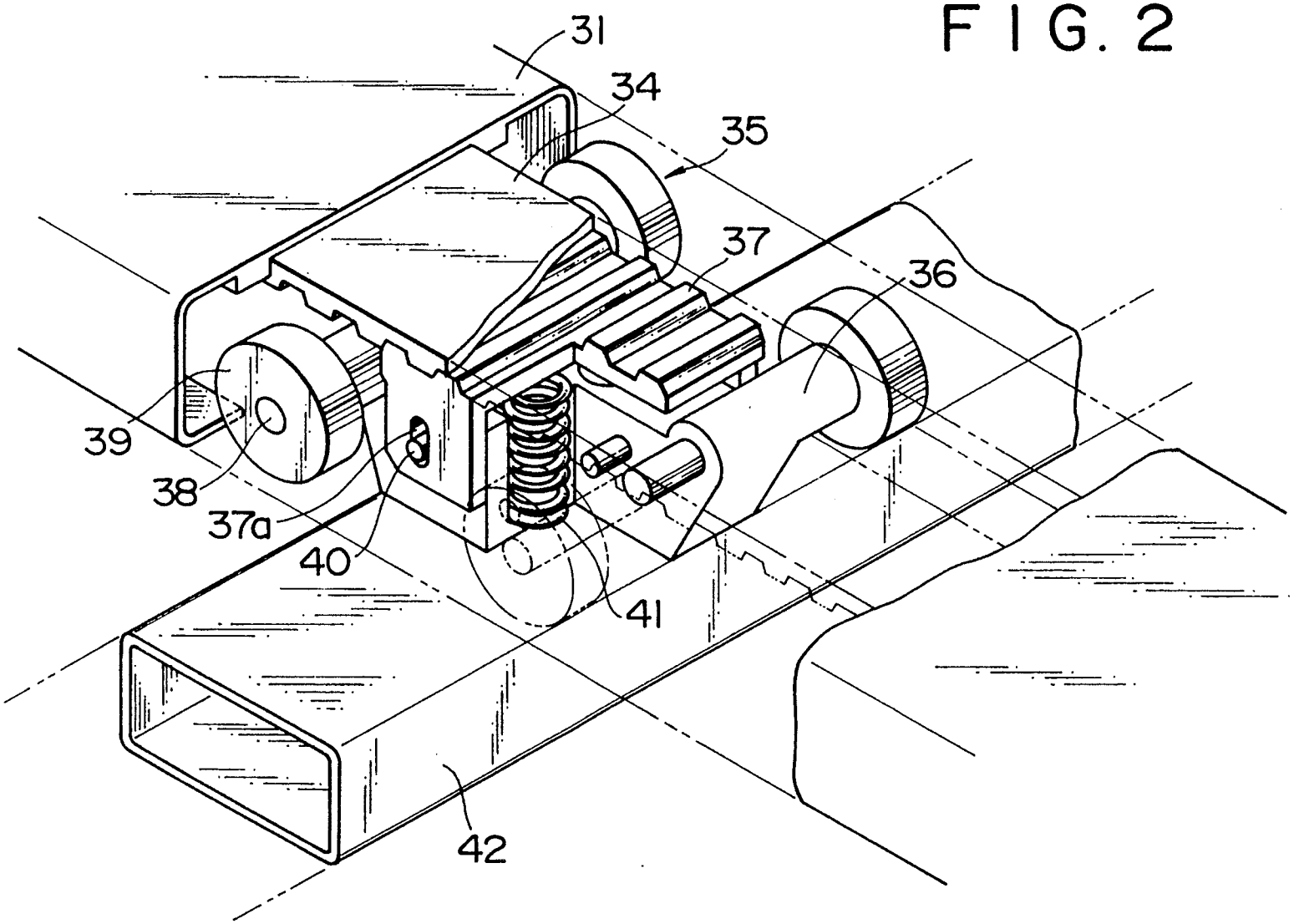
FIG. 2 is a perspective view of a drive section of a clamping device in accordance with an embodiment of the present invention.
Figure 3:
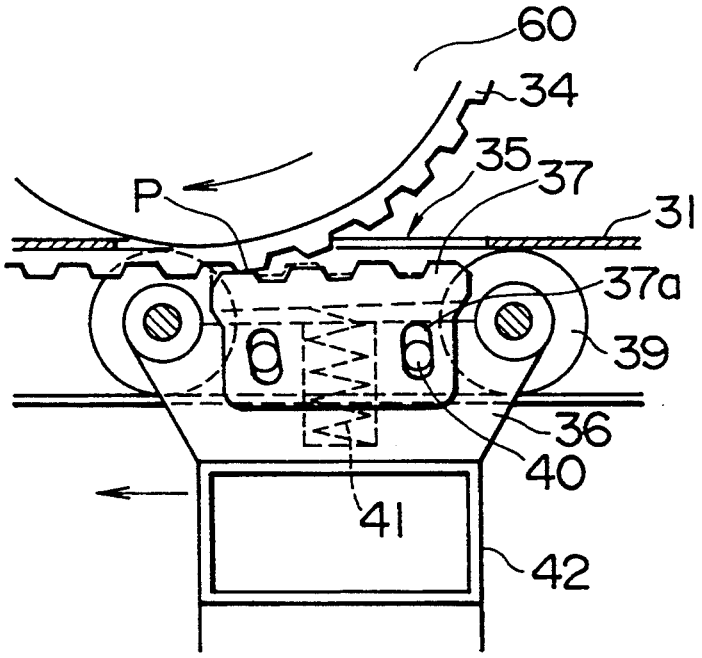
FIG. 3 is a side view illustrating the operation of the drive section of a clamping device shown in FIG. 2.

Since the clamp driving is performed with the toothed belt 34, the drive section of the clamp is constructed as shown in FIGS. 2 and 3. Two pairs of four wheels 39, which rotate in the drive conveyor rail 31, are mounted to shafts 38 fixed to a clamp body 36, and a toothed block 37, which has a plurality of tooth-shaped protrusions to engage with the toothed belt 34 for driving clamps, is installed to the clamp body 36 so that it can be moved downward by the height of the tooth-shaped protrusion. Namely, the toothed block 37 is disposed so as to straddle over the clamp body 36. The toothed block 37 is secured by inserting two pins 40, which are fixed to the clamp body 36, into longitudinally elongated holes 37*a*, which are drilled in the side walls of the toothed block 37. A compression spring 41, which is energized so as so push the toothed block 37 in the engaging direction, is installed between the clamp body 36 and the toothed block 37.

Figure 4:
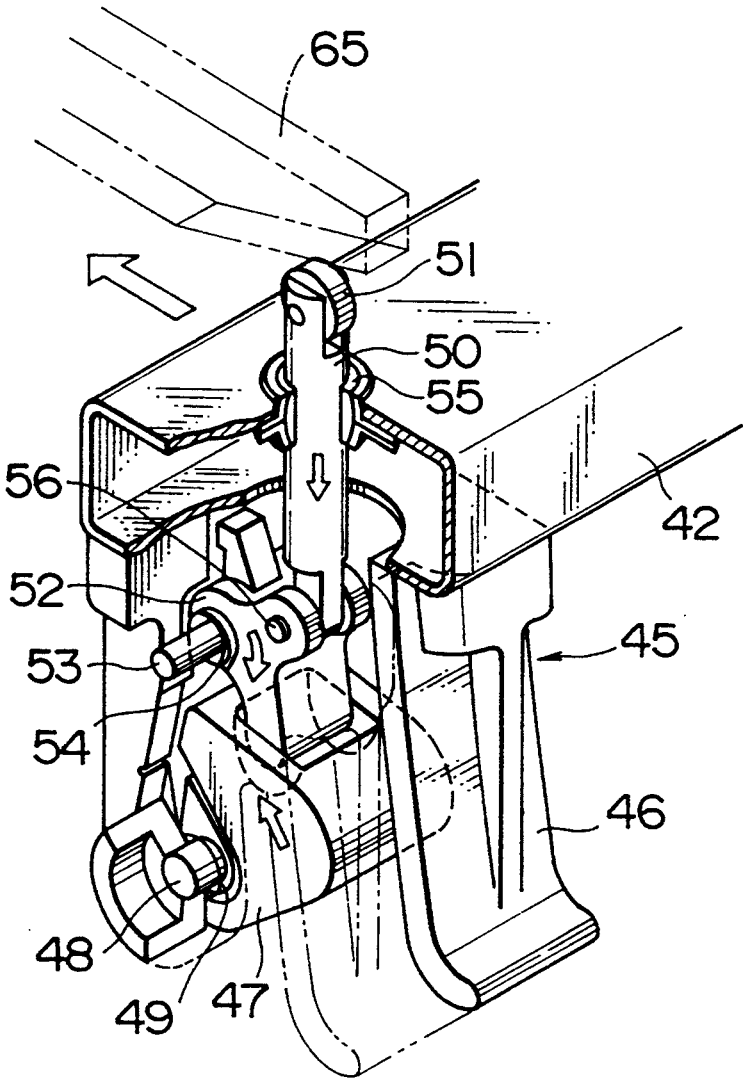
FIG. 4 is a perspective view of a sheet clip in accordance with an embodiment of the present invention.
Figure 5:
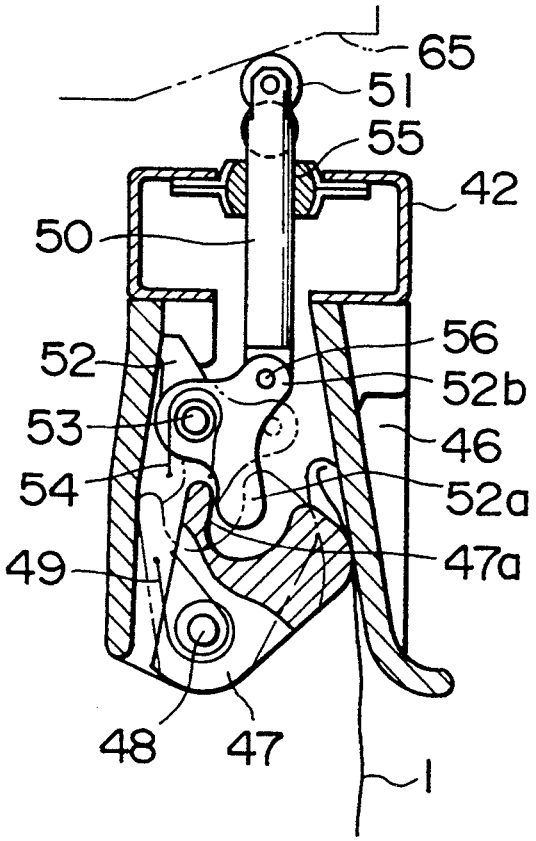
FIG. 5 is a longitudinal sectional view of the sheet clip shown in FIG. 4.

Next, the clip 45 for gripping the sheet will be described with reference to the perspective view of FIG. 4 and the sectional view of FIG. 5. The clip 45 is constructed so that all moving parts are housed in a clip housing 46. A pin 48 is installed to the clip housing 46, and a sheet grip member 47 is supported by the pin 48 so as to rotate freely. Around the outer periphery of the pin 48, a torsion spring 49 is wound, which is energized in the direction such that the sheet grip member 47 is pressed against the clip housing 46 to grip the sheet. The contact angle between the clip housing 46 and the grip member 47 is set so that when the sheet is once gripped, the gripping force becomes higher as the force of pulling the sheet in the direction in which the weight of the sheet is applied increases.

A sheet release bar 50 extends over the clip 45 in such a manner that it can be moved vertically. A roller 51 is secured to the sheet release bar 50 with a pin, and the lower part of the sheet release bar 50 is connected to an arm 52*b* of a cam lever 52, which opens/closes the sheet grip member, with a pin 56. The cam lever 52 is supported on the clip housing 46 by a pin 53, and energized by a torsion spring 54 so as to raise the sheet release bar 50. Another arm 52*a* of the cam lever 52 engages with a concave portion of the sheet grip member 47. When the sheet release bar 50 is pushed down and the cam lever 52 is turned, the arm 52*a* pushes a wall 47*a* of the concave portion of the sheet grip member 47 and turns the sheet grip member 47 to release the sheet gripping portion from the clip housing 46. If the sheet 1 is gripped, it can be released.

Figure 6:
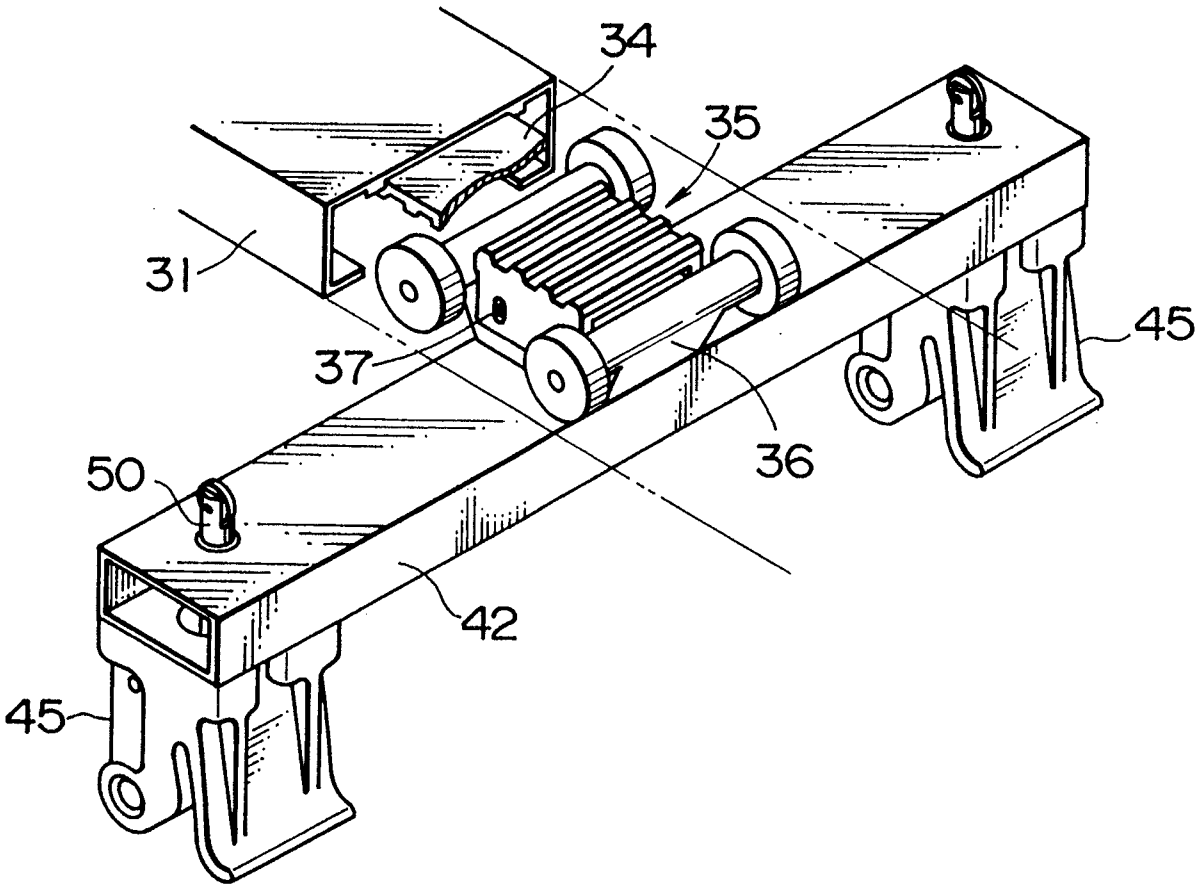
FIG. 6 is a perspective view of the clamping device shown in FIG. 2.
Figure 7:
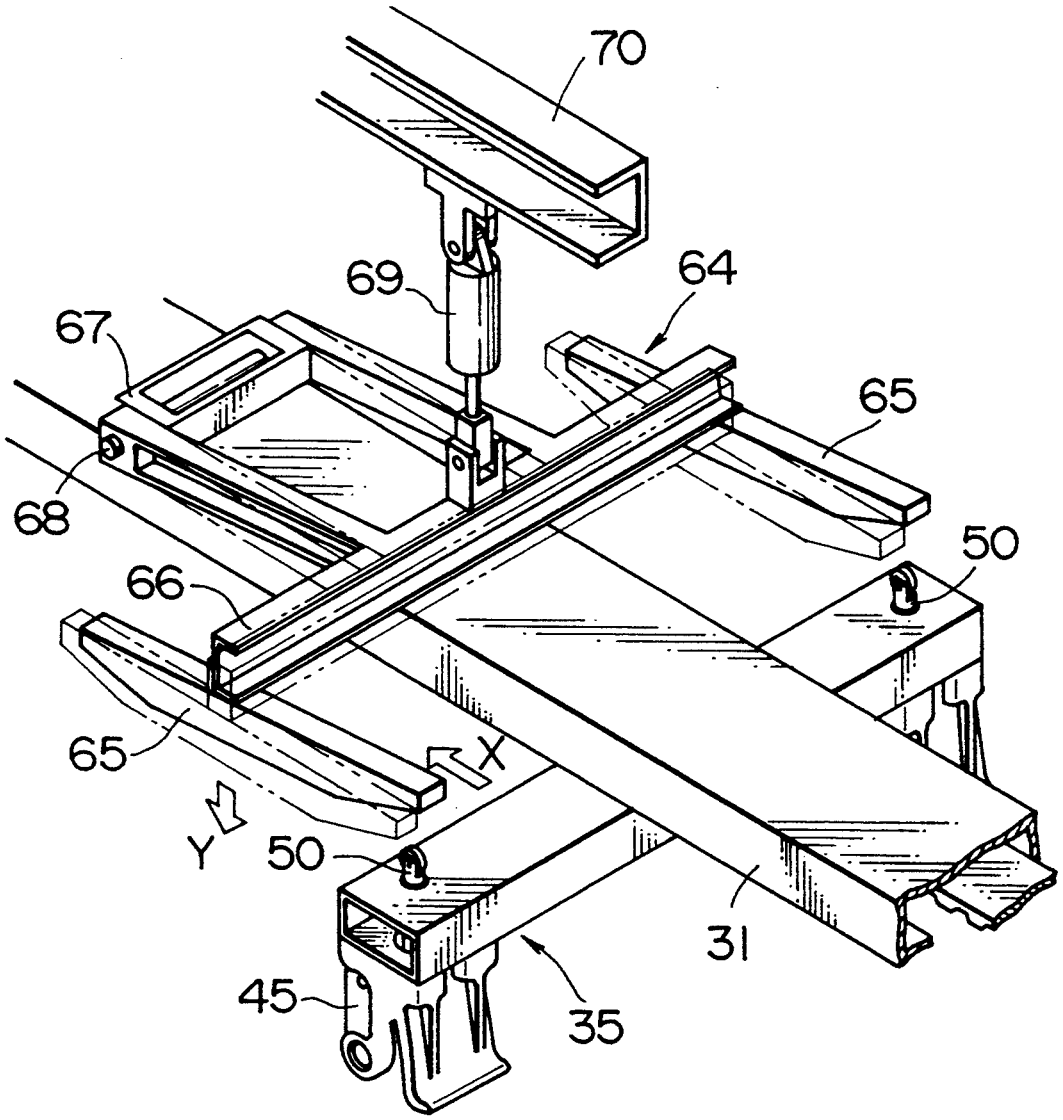
FIG. 7 is a perspective view of sheet grip releasing device in accordance with an embodiment of the present invention.

As shown in FIG. 6, the clip 45 is installed at each end of the clamp girder 42 installed horizontally and at right angles to the running direction of the clamp body 36. The clamp 35 is thus constituted. FIG. 7 is a perspective view of the sheet grip releasing device 64. In FIG. 7, an actuating lever 66 is supported by a pin 68 of a support 67 mounted on the drive conveyor rail 31, and a cam plate 65 is installed on each side of the actuating lever 66. The actuating lever 66 is connected, with a pin, to an air cylinder 69, which is secured to a fixed member 70 with a pin. When the clamp 35 travels in the direction of arrow X and lies under the cam plate 65, the cam plate 65 lowers in the direction of arrow Y, that is, to the position indicated by a two-dot chain line in FIG. 7, by the operation of the air cylinder 69, and pushes the sheet release bar 50. Therefore, the sheet 1 is released from the clamp 35.

Figure 8:
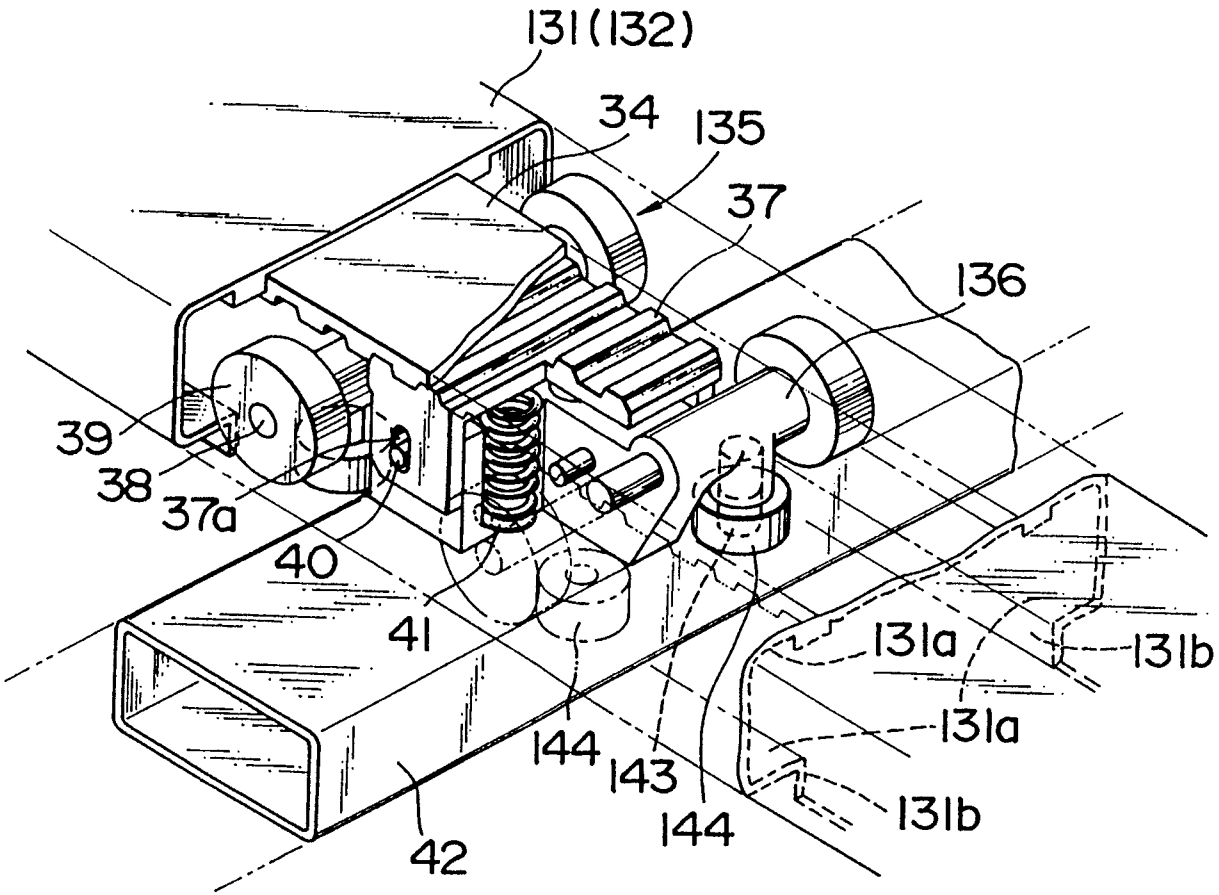
FIG. 8 is a detailed perspective view of a clamp drive section shown in FIG. 1 in accordance with another embodiment of the present invention.
Figure 9:
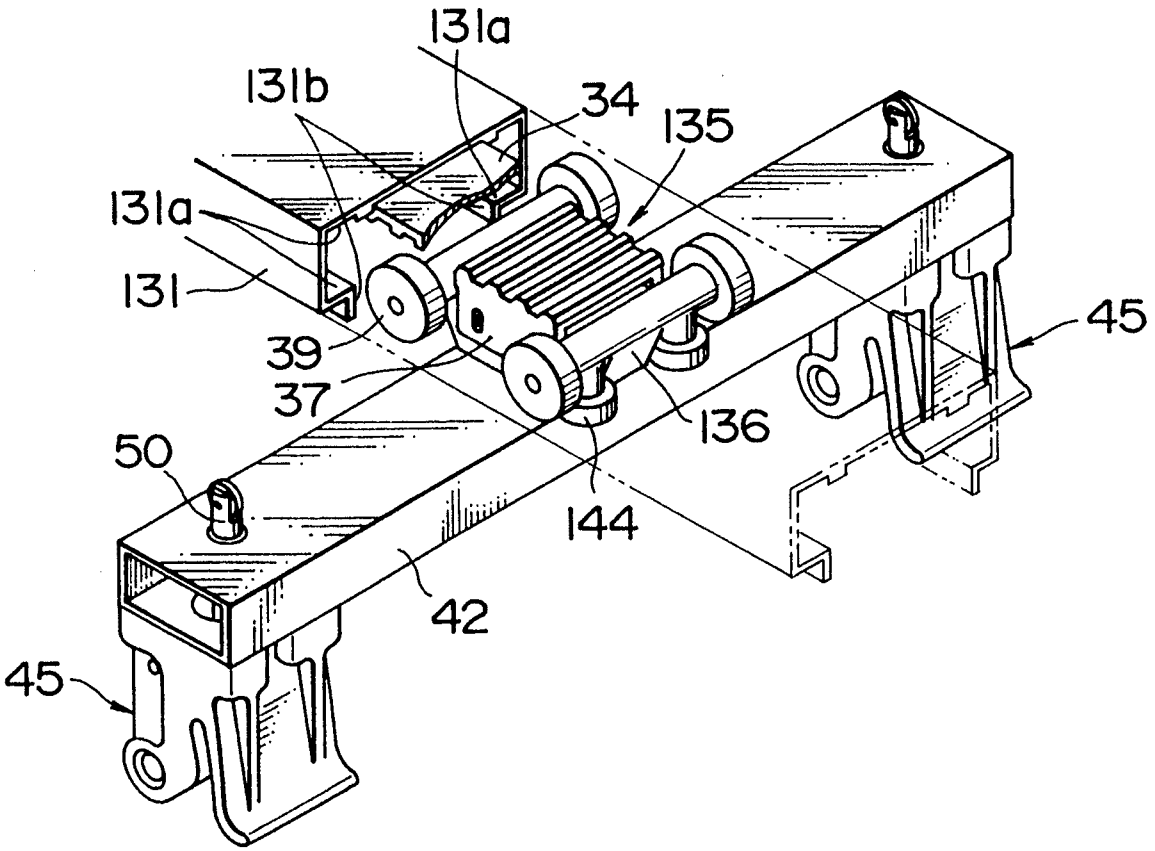
FIG. 9 is a perspective view of a clamping device in accordance with another embodiment of the present invention.
Figure 10:
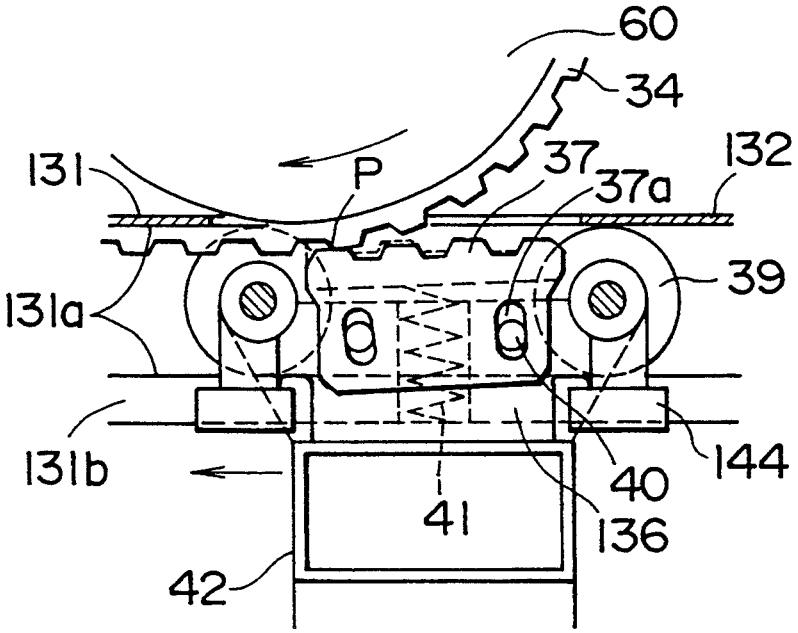
FIG. 10 is a side view illustrating the operation of the drive section of a clamping device shown in FIG. 1 in accordance with the present invention.

FIGS. 8 through 10 show another embodiment of a clamp drive section. In this embodiment, the drive conveyor rail 131 and the free conveyor rail 132 (both have the same shape of rail cross section) have a pair of opposing rails 131*a* which vertically guide a clamp body 136 and a set of opposing rails 131*b* which transversely guide the clamp body 136. The drive section has a guide for the drive belt.

The clamp body 136 is provided with two pairs of four wheels secured to shafts 38 fixed to the clamp body 136 so as to rotate freely. These four wheels 39 are guided by the opposing rails 131*a* of the drive conveyor rail 131. Similarly, two pairs of four wheels 144 are secured to vertical shafts 143 fixed to the clamp body 136 so as to rotate freely. These four wheels 144 are guided by the opposing rails 131*b* of the drive conveyor rail 131.

Next, the operation of the clamp will be described. In the clamp 135, the wheels 39 are guided vertically by the rails 131*a*, and the wheels 144 are similarly guided transversely by the rails 131*b* in both the drive conveyor rail 131 and the free conveyor rail 132, so that the clamp 135 does not strike against the drive conveyor rail 131 or the free conveyor rail 132 and stops or rubs it during running.

Thus, the clamp 135 of the present invention, when running in the conveyor rail 131, travels while its longitudinal and transverse inclination is controlled with two pairs of wheels 39, which are supported by the horizontal shafts fixed to the clamp body 136, being guided by the rails 131*a*, which vertically guide the clamp body 136 in the conveyor rail 132. At the same time, two pairs of wheels 144, which rotate horizontally by being supported by the vertical shafts 143, are guided by a set of opposing rails 131*b*, which transversely guide the clamp body 136 in the conveyor rail 131, so that the clamp 135 travels while being controlled not to move transversely during running.

Figure 11:
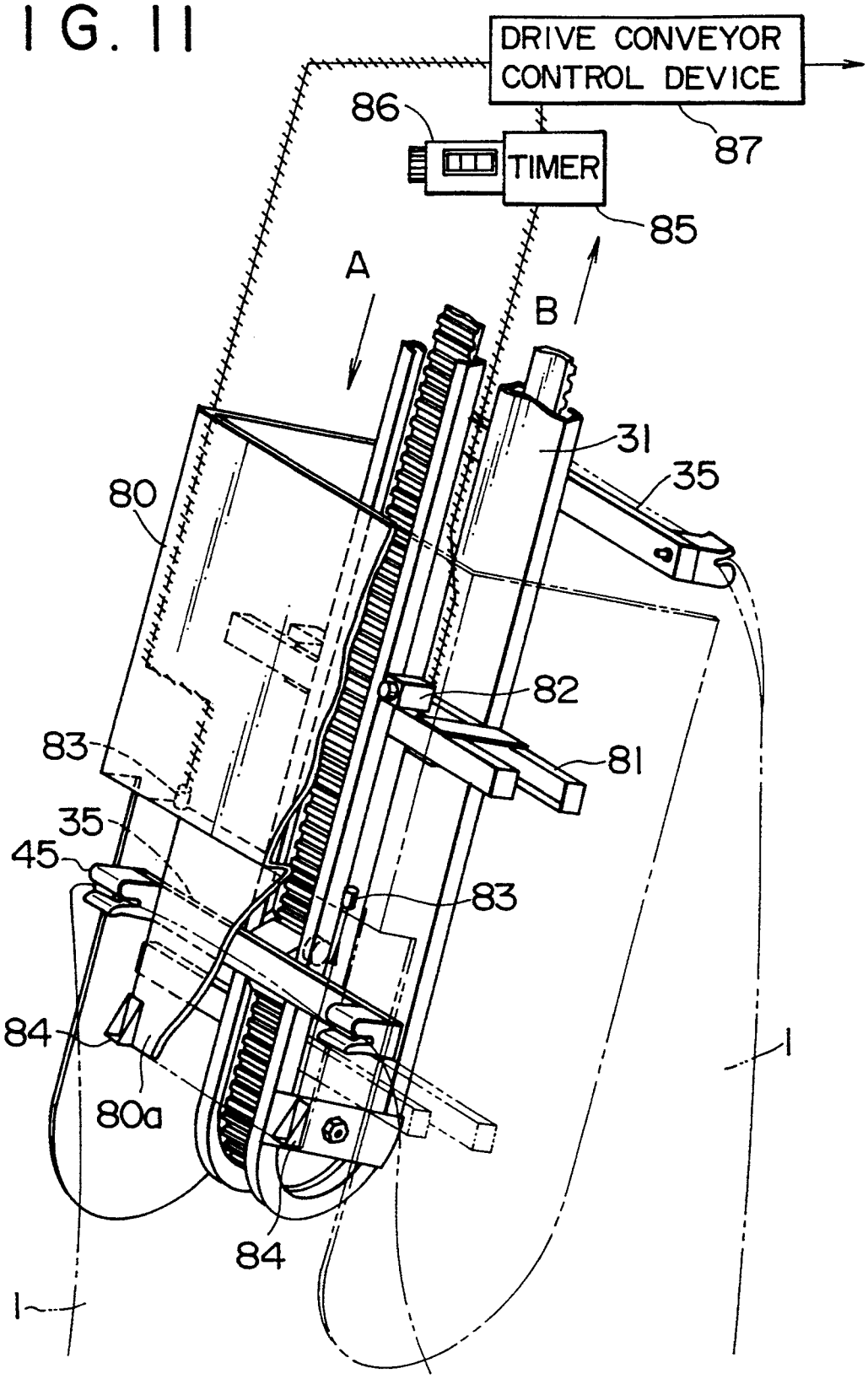
FIG. 11 is a partially cutaway perspective view of a sheet supply position adjusting device and a sheet grip verification device in accordance with an embodiment of the present invention.

FIG. 11 shows a supply work height adjusting device at the drive conveyor rail 31 of sheet supply section in accordance with the embodiment of the present invention. In this FIGURE, the empty clamp 35 is lowered slantwise in the direction of arrow A on the drive conveyor rail 31. At the halfway position of the drive control rail 31, a proximity sensor 82 is installed to detect the passing of the clamp. The signal generated by the proximity sensor 82 is sent to a timer 85 having a setting device 86. Reference numeral 87 denotes a drive conveyor control device for controlling a not illustrated conveyor drive motor in accordance with the output of the timer 85. Reference numeral 80 denotes a safety cover for the worker which covers the sheet supply section installed to the drive conveyor rail 31 by an attaching member 81.

Also, FIG. 11 shows a sheet grip verification device on the drive conveyor rail 31 of the sheet supply section. A photoelectric sensors 83 which also have a light source emitting a light beam (x—x) each are installed at the front bent portion of the cover 80. A pair of light beam reflectors 84 are installed at the edge of a support plate 80*a* which is integral with the cover 80. The light beam (x—x) runs in parallel to the running direction of the conveyor at a height at which it is intercepted when the sheet is properly gripped by a pair of clips 45 of the sheet holding clamp 35, going and returning back by being reflected by the reflector 84. The photoelectric sensors 83 send a signal telling the interception of light beam (x—x) to the drive conveyor control device 87.

Figure 12:
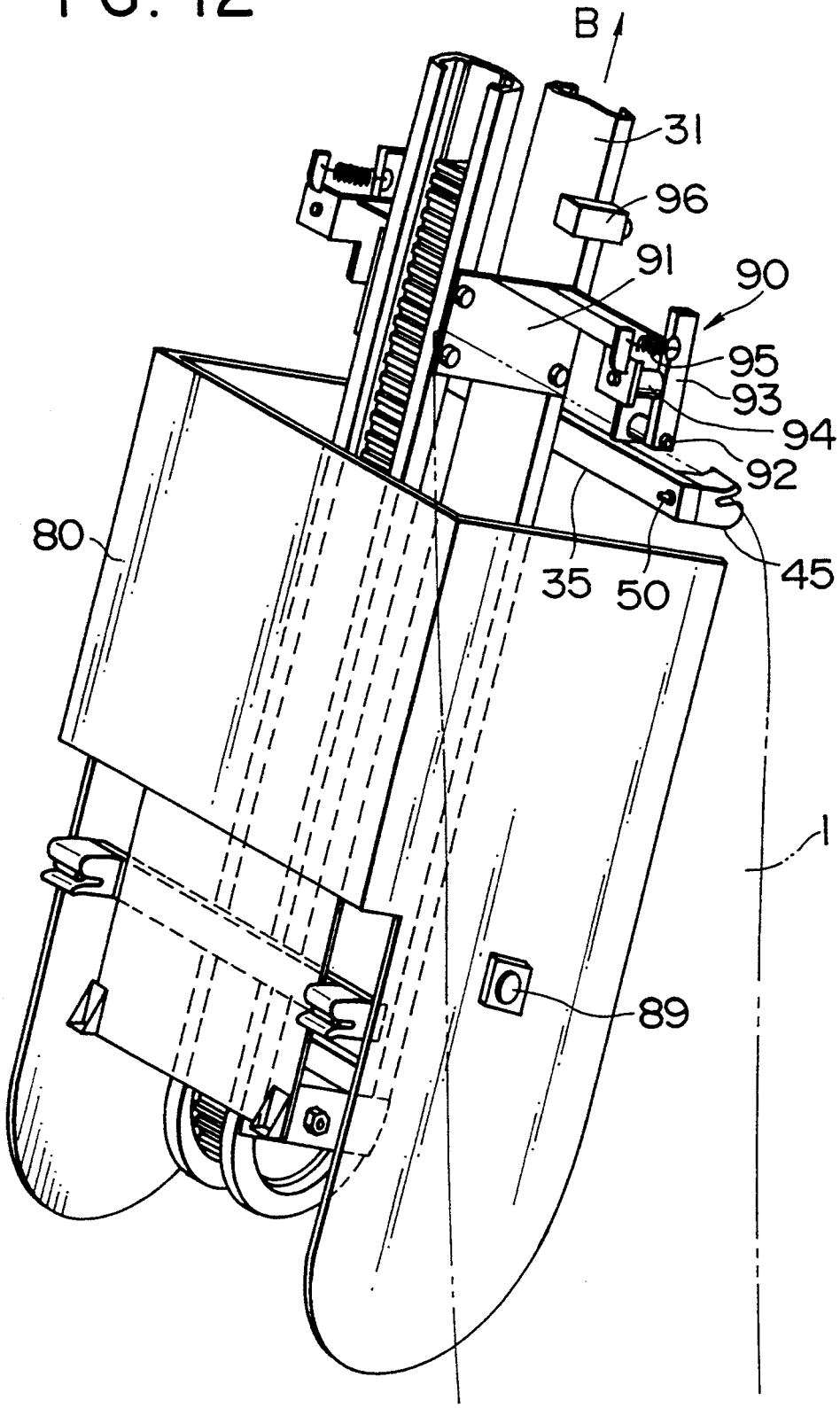
FIG. 12 is a perspective view of a sheet grip releasing device at the sheet supply section in accordance with an embodiment of the present invention.
Figure 13:
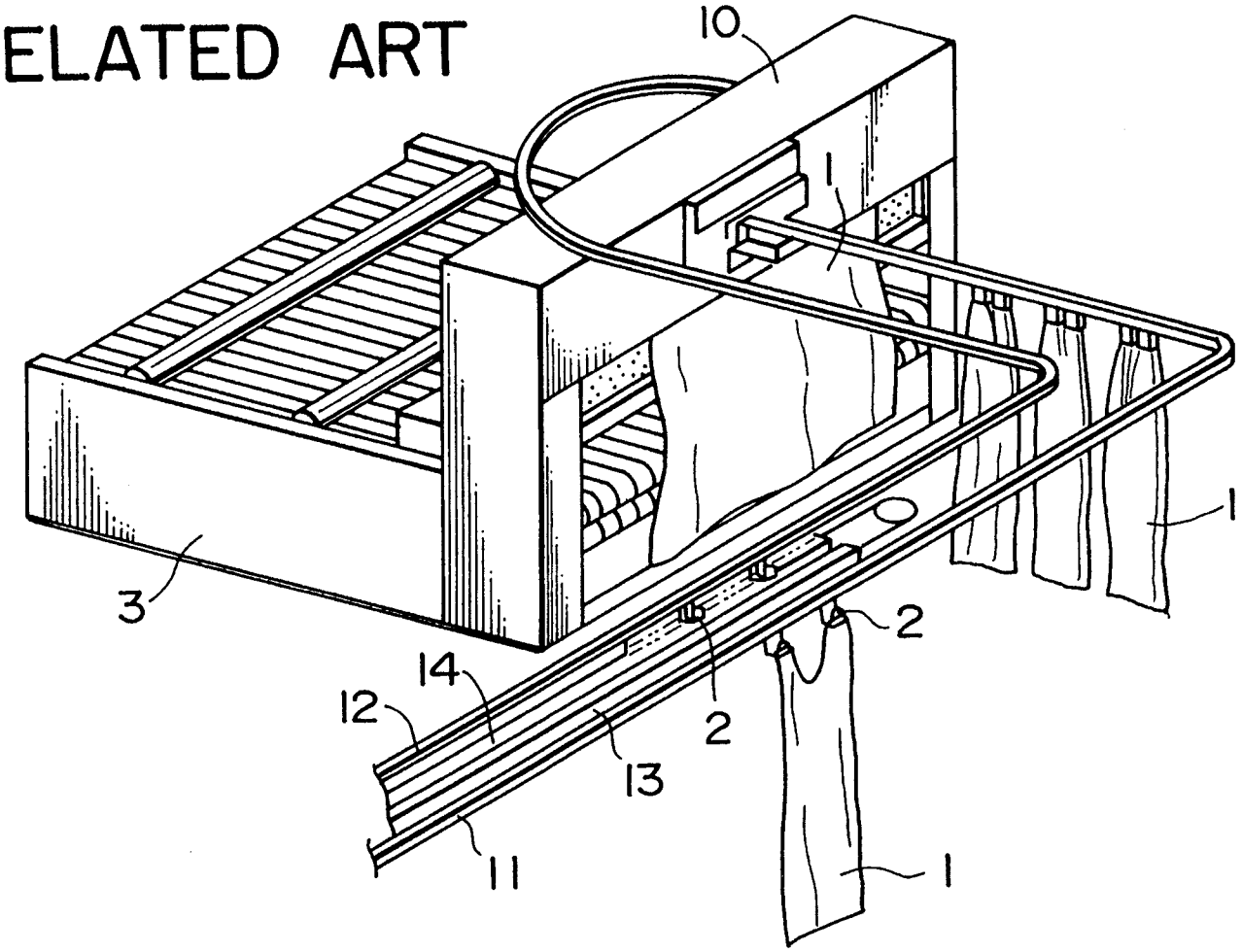
FIG. 13 RELATED ART
FIG. 13 is a perspective view of a conventional linen carrying apparatus.
Figure 14:
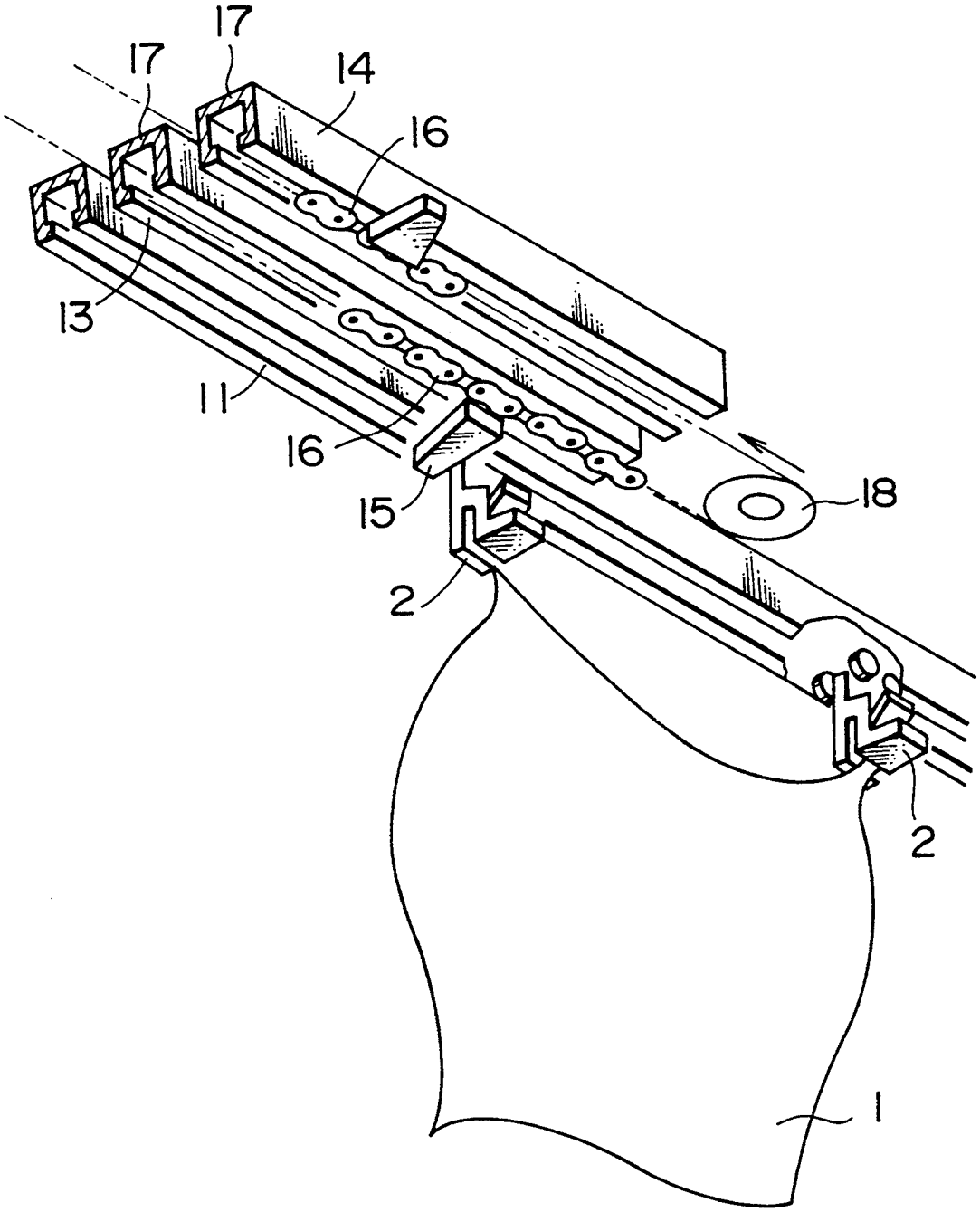
FIG. 14 RELATED ART
FIG. 14 is a perspective view of a conveyor section in FIG. 13.
Figure 15:
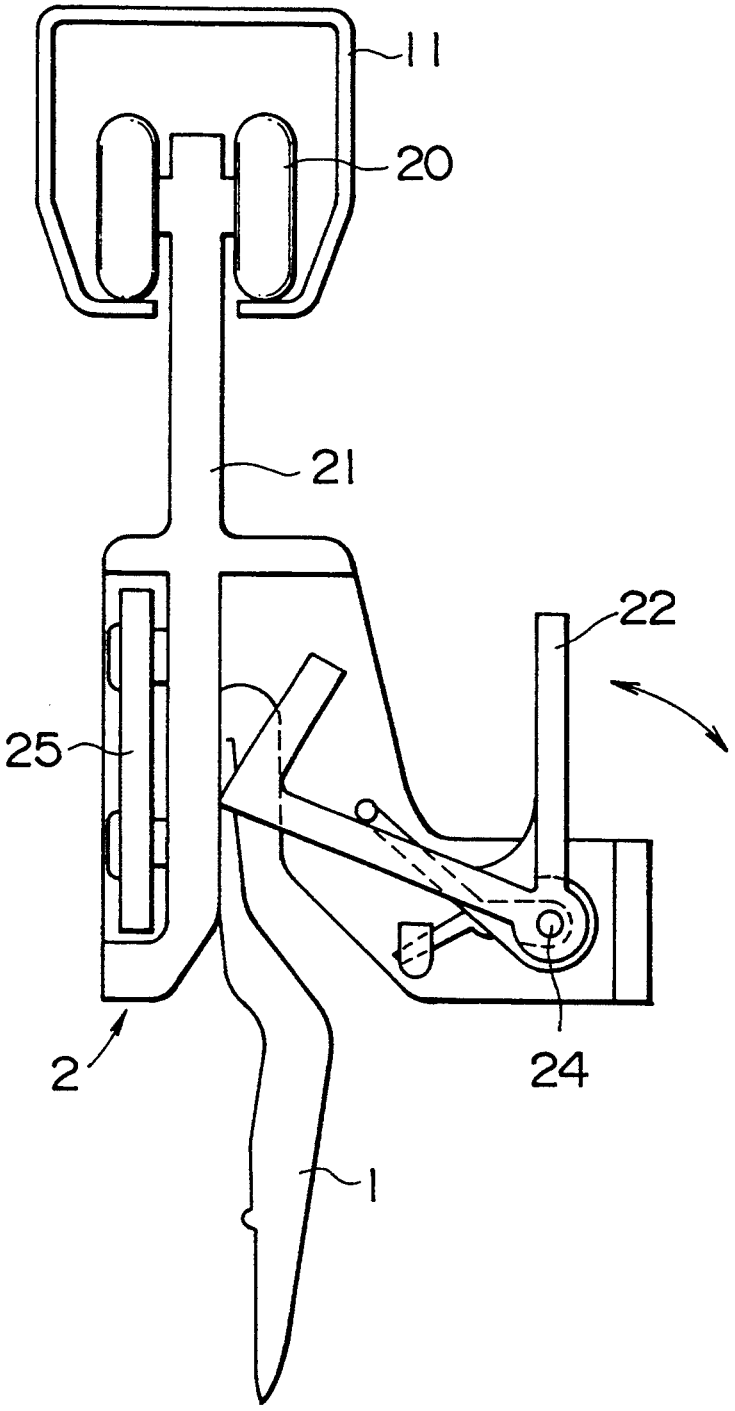
FIG. 15 RELATED ART
FIG. 15 is a front view of a chuck for a conventional conveyor.
Figure 16:
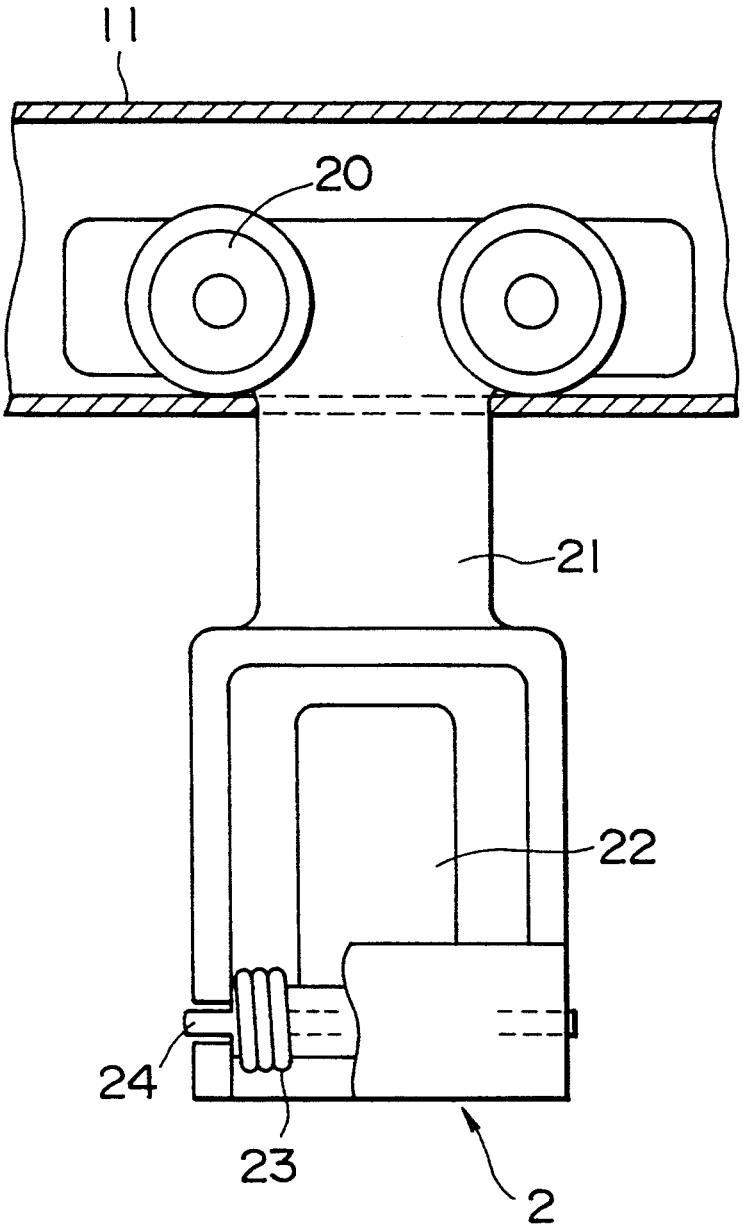
FIG. 16 RELATED ART
FIG. 16 is a side view of a chuck shown in FIG. 15.

FIG. 12 shows a sheet grip releasing device 90 at the sheet supply section. In FIG. 12, a push-button switch 89 for activating the sheet grip releasing device 90 is installed on the cover at a position reached by the worker. Here, the construction and function of the sheet grip releasing device 90 will be described. A cam 93 is supported by a pin 92 fixed to the support body 91 installed to the drive conveyor rail 31 in such a manner so as to rotate freely. The cam 93 is operated by an actuating rod of an air cylinder 94 fixed to the support body 91, and pulled up by a tension spring 95.

In the condition where the cam 93 is pushed out downward and slantwise by the operation of the cylinder 94, when the clamp 35 passes through this position, the cam 93 pushes the sheet release bar 50 of the clip 45, by which the clip 45 releases the sheet 1. A proximity sensor 96 installed to the drive conveyor rail 31 shuts off the electrical circuit for keeping the operation of the cylinder 94 and relieves the air pressure in the cylinder 94 to return the cam 93 to its original position.

Next, the operation of the embodiment constituted as described above will be described. As shown in FIG. 3, when the toothed belt 34 for driving begins to engage with the clamp 35, even if the tooth of the toothed belt 34 interferes with the tooth of the toothed block 37 on the side of the clamp 35 (indicated by P in FIG. 3), the toothed block 37 gets away in the direction apart from the toothed belt 34 to avoid the interference as indicated by a solid line in the figure. The toothed block 37 returns at a correct engagement position by the action of the compression spring 41, thereby the clamp 35 being driven normally.

The sheet 1 can be secured to the clamp 35 merely by pushing the corner or the side edge of the sheet 1 between the clip housing 46 and the sheet grip member 47 from the lower side. When the clamp 35 comes to the position where the release of sheet is desired, the air cylinder 69 is operated, by which the cam plate 65 lowers in the direction of arrow Y to push the sheet release bar 50, thereby the sheet 1 being released from the clamp 35. Since all moving parts of the clip 45 are housed in the clip housing 46, the troubles of caught or contaminated sheets can be eliminated.

In the apparatus shown in FIG. 1, the sheet 1 can be gripped by spreading only a certain width. The sheet 1 secured to the clamp 35 by a worker S2 is handled in the order of $A_1$, $B_1$, $C_1$, $D_1$, E, F, G, H, I, $J_1$, and $A_1$ as with the case of the sheet 1 secured by the worker S1.

In the sheet supply section shown in FIG. 11, when the proximity sensor 82, which is installed on the drive conveyor rail 31 running slantwise in the direction of arrow A, detects the passing of the clamp 35, the timer 85 is activated by the signal from the proximity sensor 82. By the output signal of the timer 85 sent after a time period set by a setting device 86, the drive conveyor is stopped for supplying the sheet 1. Also, by adjusting the set time of timer 85 by means of the setting device 86, the stop position of the clamp 35, that is, the supply height of sheet 1 can be adjusted. The restart of conveyor after the supply of sheet 1 is performed by worker's pushing operation of a not illustrated restart switch.

Further, in the sheet supply section shown in FIG. 11, when the sheet 1 is properly held in the pair of clips 45 of the clamp 35 stopping at the supply position of the sheet 1, the edge of the sheet 1 intercepts the light beam (x—x) running between the clips 45, by which the photoelectric sensor 83, which receives the light beam, generates a signal telling the interception of light. Therefore, the gripping of the sheet can be verified. This verification signal can be changed into a conveyor start signal. Even if the sheet supply height is changed by the sheet supply height adjusting mechanism as described above, there is no problem because there is a sufficient distance between the photoelectric sensor 83 and the reflector 84.

In the sheet supply section shown in FIG. 12, the worker can see the sheets which has been supplied just before rising slantwise in the direction of arrow B in front of his/her eyes. If the sheet 1 is incompletely gripped and one clip does not grip the sheet 1, if the corner of sheet is gripped by the reverse one of the clips 45, or if a defect such as a tear is found, the operator pushes the push-button switch 89. By this operation, the excitation circuit of the air pressure cylinder 94 is held, the sheet grip releasing device 90 being activated to protrude the cam 93, so that the clips 45 can release and drop the sheet 1. When the clamp 35 passes through the proximity sensor 96 after passing through the sheet grip releasing device 90, the holding of the excitation circuit of the air pressure cylinder 94 is shut off by the signal of the proximity sensor 96, the original condition being restored.

We claim:

1. In a conveyor for carrying linens which includes the processes of: gripping a linen on any corner and one place on a side of said linen including said corner of a rectangular cloth with clips installed on a movable clamp; moving the cloth onto the top surface of a table by using said clamp; and pulling the cloth onto said table, said conveyor for carrying linens including a drive section comprising:

a clamp body;

two pairs of wheels supported by shafts fixed to said clamp body;

a toothed block which has a plurality of tooth-shaped protrusions engaging with a toothed belt for driving the clamp body in a running direction and is installed straddling over said clamp body by a pin inserted into an elongated hole so that said block is movable in a downward direction by the height of said tooth-shaped protrusions; and a compression spring which is energized so as to push said toothed block in an engaging direction, and is engaged between said clamp body and said toothed block.

2. A conveyor for carrying linens according to claim 1 wherein said drive section has a clip for gripping a cloth, said clip comprising:

a clip housing;

a pin installed to said clip housing;

a cloth gripping member which is supported by said pin and rotates in said clip housing;

a torsion spring biasing said cloth gripping member against said clip housing;

a cloth release bar extending over said clip in such a manner that said release bar is movable vertically; and a cam lever which engages with said cloth release bar and opens/closes said cloth gripping member.

3. A conveyor for carrying linens according to claim 2 wherein a pair of clips are installed to both ends of a girder mounted horizontally and at right angles to the running direction of said clamp body.

4. A conveyor for carrying linens according to claim 1 wherein said conveyor for carrying linens comprises:

a pair of opposing rails for vertically guiding said clamp body;

a set of opposing rails for transversely guiding said clamp body;

a toothed belt running in a conveyor rail;

said two pairs of wheels are supported by horizontal shafts fixed to said clamp body and guided by said pair of opposing rails; and two pairs of wheels which are supported by vertical shafts fixed to said clamp body and guided by said set of opposing rails.

5. In a conveyor for carrying linens having a linen supply section where a linen holding clamp including clips is put on a drive conveyor in a running direction after running on an inclined free conveyor, wherein one corner and an adjacent side of a rectangular cloth are gripped by said clips, and then said clamp rises slantwise to hang the cloth, said conveyor for carrying linens including a linen supply work height adjusting device comprising:

a proximity sensor which is installed at a halfway position of a rail of said drive conveyor running down slantwise and detects the passing of said clamp;

a timer with an adjustable setting device which is activated by the signal from said proximity sensor; and control means which stops said conveyor by means of the output signal generated after the set time of said timer.

6. A conveyor for carrying linens according to claim 5 wherein said conveyor for carrying linens includes a linen grip verifying means comprised of:

a source of light beam parallel to the running direction of said conveyor and between a pair of clips of a linen holding clamp, and light sensors for receiving said light beam the receipt of a light beam comprising an indication that a linen has been improperly gripped.

* * * * *